US007694447B1

(12) United States Patent
Rutler et al.

(10) Patent No.: US 7,694,447 B1
(45) Date of Patent: Apr. 13, 2010

(54) WEATHER RESISTANT CONTAINER FOR STORING ROLLED CONSTRUCTION DOCUMENTS AND DISPLAY FOR BUILDING PERMITS

(75) Inventors: Jay B. Rutler, Overland Park, KS (US); Spencer B. Hawerlander, Olathe, KS (US); Tony Robert Plunkett, Olathe, KS (US)

(73) Assignee: Pro-Vent, Inc., Olathe, KS (US)

( * ) Notice: Subject to any disclaimer, the term of this patent is extended or adjusted under 35 U.S.C. 154(b) by 801 days.

(21) Appl. No.: 11/323,528

(22) Filed: Dec. 30, 2005

(51) Int. Cl.

| | |
|---|---|
| ***G09F 3/18*** | (2006.01) |
| ***G09F 3/20*** | (2006.01) |
| ***A41F 1/00*** | (2006.01) |
| ***B25B 31/00*** | (2006.01) |
| ***G07C 13/02*** | (2006.01) |
| ***A47G 29/14*** | (2006.01) |

(52) U.S. Cl. ..... 40/654.01; 40/660; 40/606.05; 40/606.15; 40/611.01; 40/611.09; 24/456; 24/20 LS; 24/279; 232/33; 232/45; 232/30; 232/31; 232/32; 232/43; 232/2; 232/38; 232/17; 248/309.2

(58) Field of Classification Search ..... 40/654.01, 40/660, 606.05, 606.15, 611.01, 611.09; 24/456, 20 LS, 279; 232/33, 45, 30, 31, 32, 232/43.2, 38, 17; 248/309.2
See application file for complete search history.

(56) References Cited

U.S. PATENT DOCUMENTS

| | | | | | |
|---|---|---|---|---|---|
| 772,256 | A | * | 10/1904 | Schmoyer | 232/34 |
| 2,127,170 | A | * | 8/1938 | Haslam | 40/654.01 |
| 2,315,158 | A | | 3/1943 | Markham | |
| 2,532,289 | A | * | 12/1950 | Cahill | 232/17 |
| 3,927,792 | A | | 12/1975 | Andrade et al. | |
| 4,334,373 | A | | 6/1982 | Bryan | |
| 4,574,504 | A | | 3/1986 | Holmer | |
| 4,607,809 | A | * | 8/1986 | Sineni et al. | 242/560 |
| 4,821,440 | A | | 4/1989 | Dunn | |
| 4,986,431 | A | | 1/1991 | McCarter | |
| 5,513,746 | A | | 5/1996 | Anderson | |
| 5,623,778 | A | | 4/1997 | Dunn | |
| 5,664,851 | A | | 9/1997 | Dunn | |
| 6,012,786 | A | | 1/2000 | Dunn | |
| 6,056,233 | A | * | 5/2000 | Von Schenk | 242/594.5 |
| 6,405,972 | B1 | * | 6/2002 | Wakam | 242/597.7 |
| 6,619,627 | B2 | * | 9/2003 | Salisbury et al. | 256/1 |
| 6,860,573 | B2 | | 3/2005 | Dunn et al. | |

(Continued)

*Primary Examiner*—Lesley Morris
*Assistant Examiner*—Syed A Islam
(74) *Attorney, Agent, or Firm*—Erickson, Kernell, Derusseau & Kleypas, LLC

(57) ABSTRACT

A storage device for storing rolled documents includes a tube pivotally mounted to a housing and advanceable between retracted and extended positions relative to a roof of the housing. The roof covers an open end of the tube in the retracted position. In the extended position, the open end of the tube is advanced away from the roof to permit rolled construction drawings to be inserted into and removed from the tube. A floor extends across at least a portion of the tube to prevent the rolled documents from falling out of the tube. Clamps mounted on the housing enable mounting of the storage device on a post, such as a T-post. The storage device may include a display panel having a pocket formed by a sheet of transparent flexible plastic into which a building permit may be positioned and displayed.

12 Claims, 3 Drawing Sheets

U.S. PATENT DOCUMENTS 6,883,785 B1 * 4/2005 Knapp ..... 256/10
7,178,691 B1 * 2/2007 Rux ..... 221/191
7,278,604 B1 * 10/2007 Constantino ..... 242/597.7
2003/0234599 A1 12/2003 Dunn et al.

* cited by examiner

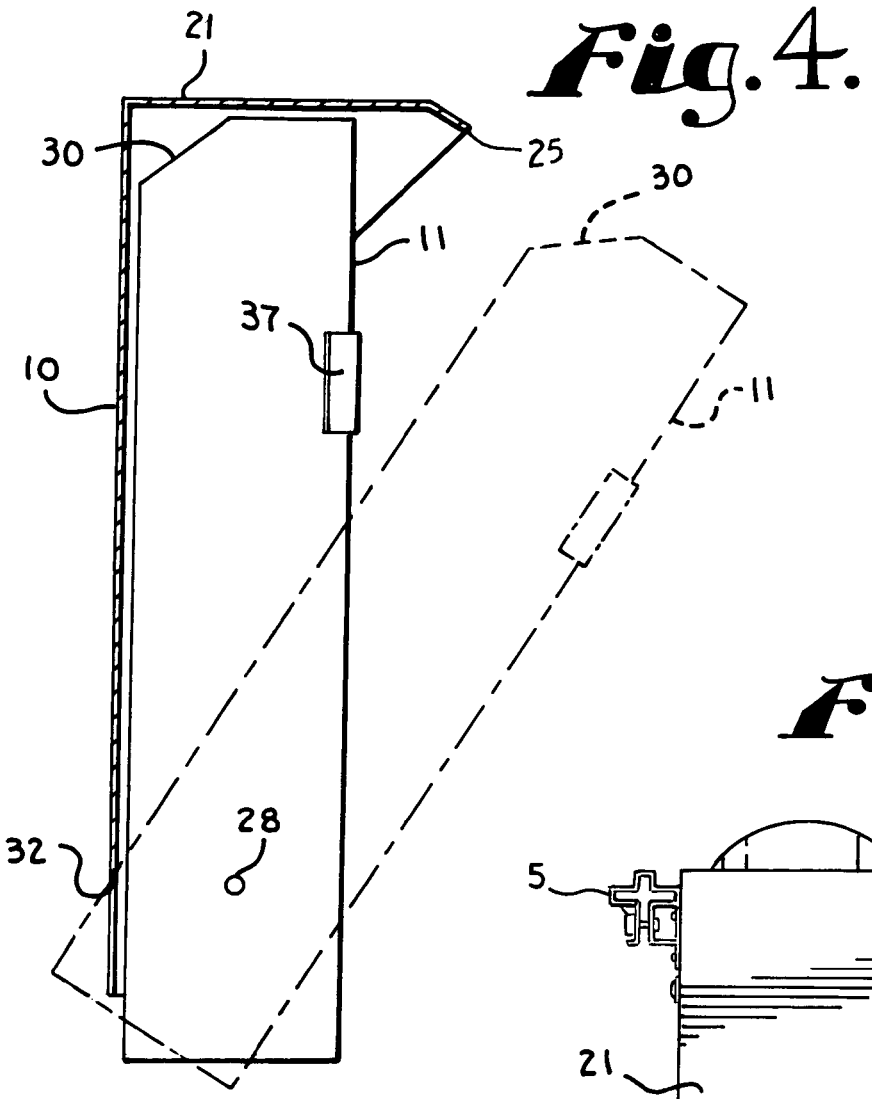
Fig. 4.
Fig. 5.
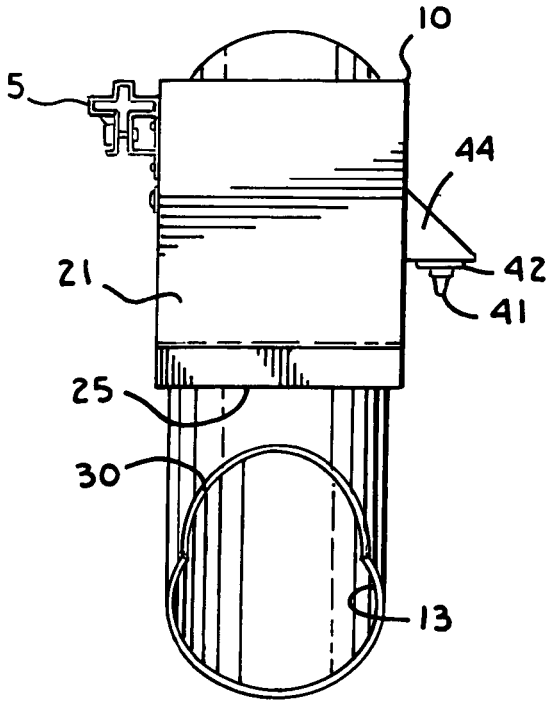

WEATHER RESISTANT CONTAINER FOR STORING ROLLED CONSTRUCTION DOCUMENTS AND DISPLAY FOR BUILDING PERMITS

BACKGROUND OF THE INVENTION

1. Field of the Invention

The present invention relates to storage and display devices for storing documents at a construction site and which also permit display of a building permit and storage of other documents at the construction site.

2. Description of the Related Art

Many cities require building permits to be displayed and accessible to inspectors at construction sites. In addition to providing information concerning the basis for the permit, the document may have checkoff spaces for completion by various inspectors during the construction process. It is also convenient to be able to store a set of large format construction drawings at the work site for access by subcontractors, inspectors or the property owner during the construction process. Some jurisdictions require the builder's stamped and city-sealed copy of the plans be made accessible to the inspectors at the construction site. Due to their size, construction drawings are typically rolled into a cylindrical shape for storage.

A wide range of display systems have been developed to permit the weather resistant display of building permits on a construction site while permitting access by inspectors. Display devices have also been developed to store rolled construction documents at the construction job site in a weather resistant container for ready access during the construction process. Such display devices may also include structure for displaying building permits in conjunction with the rolled construction documents.

For example, U.S. Pat. No. 4,334,373 discloses a combination building permit display device and rolled blueprint holder. The device includes a flat panel base member with a pocket formed from transparent plastic sheet material for receiving and displaying a building permit while protecting it from the elements. Rolled documents are stored in a cylindrical tube with a closed end and an open end. The rolled documents are inserted in the tube and then the tube is hung on the base member with the closed end at the top and the open end resting on a shelf to prevent the drawings from falling out. The tube does protect the rolled documents from the elements if properly used. However, if an inexperienced user hangs to tube with the open end up, the tube functions as a catch basin, collecting any precipitation and forming a pool of water waterlogging any documents positioned therein. In addition, it would appear difficult to hold the documents in the tube while trying to hang the tube upside down on the base member.

U.S. Pat. No. 5,664,851 also provides a weather resistant display case for displaying construction permits and for storing rolled documents. The display case is formed from two halves, each having a semi-cylindrical recess near a hinge connecting the halves together. It is foreseen that users are likely to experience difficulty in trying to position and hold a rolled set of plans in the semi-cylindrical recess in the base member while trying to simultaneously close the front panel over the rolled plans without the plans uncoiling to the point that they are too large to fit in the mating recesses or fall out of the recess in the base member.

Another problem encountered with existing plan and permit boxes is where to mount the boxes. Existing boxes, including those discussed above, are generally adapted to be either nailed to a wall of the building under construction or nailed to a wooden stake to be driven into the ground. The ability to mount the box to a stake generally addresses the situation where the walls of the building have not yet been erected and there is no structure available yet to nail the box to. Wooden stakes however are not particularly convenient to use. Typically the installer has to bring a sledge hammer or the like to the site to drive the stake into the ground far enough so that it does not work its way out of the ground and fall over. The stakes are prone to break when driving them into the ground and the height of generally available wooden stakes positions the box mounted thereon to low for convenient access. It is also known to mount such boxes on larger wooden posts, such as 4 inch by 4 inch posts. However, installing such posts requires digging a hole and either setting the post in concrete or tamping the dirt around the post to secure it in place, requiring additional time and equipment.

There remains a need for an effective and easy to use apparatus for storing rolled construction drawings at a construction site which protects the documents from the elements and which may also provides weather resistant means for displaying of construction permits. There also remains a need for an improved system for mounting plan and permit boxes at a construction site.

SUMMARY OF THE INVENTION

The present invention comprises a storage device for storing a roll of sheets of paper which includes a cylindrical tube pivotally mounted relative to a housing. The tube is advanceable between retracted and extended positions relative to a roof or cover of the housing. The roof covers an open end of the tube when the tube is in the retracted position. In the extended position, the open end of the tube is advanced away from the roof to permit a roll of sheets of paper, such as construction drawings, to be inserted into and removed from the tube. A floor or other obstruction extends across at least a portion of the tube, typically near a lower end thereof, to prevent a roll of sheets of paper from falling past the obstruction when positioned in the tube. Mounting the tube on the housing to pivot forward to an extended position makes it easier to reach into the tube to withdraw plans, particularly when mounted in a relatively high position.

The storage device may include one or more clamps for mounting the storage device on a post. The clamps are preferably configured to facilitate mounting of the storage device on a conventional steel T-post with opposed clamping members connected together by a hinge and shaped to receive a T-post therebetween. The ability to mount the storage device on a T-post is beneficial because most contractors carry T-posts in inventory for use in supporting fencing. T-posts are easy to install and fairly sturdy relative to alternative posts and stakes.

The storage device also preferably includes a display assembly for holding and displaying flat sheets of paper such as a building permit. The display assembly may comprise a flat panel connected to the storage device with a pocket formed from flexible and transparent sheet plastic sheets mounted on the outer surface of the panel. Access to the pocket may be provided through a slit in the sheet of plastic. Space is also provided on the outer surface of the panel to affix numeric decals to display the address for the construction site.

BRIEF DESCRIPTION OF THE DRAWINGS

FIG. 4 is a fragmentary, cross-sectional view taken along line 4-4 of FIG. 2 and showing pivotal movement of a cylindrical tube of the plan box.

FIG. 5 is a top plan view of the plan box showing the cylindrical tube pivoted to an open position.

DETAILED DESCRIPTION OF THE PREFERRED EMBODIMENTS

Figure 1:
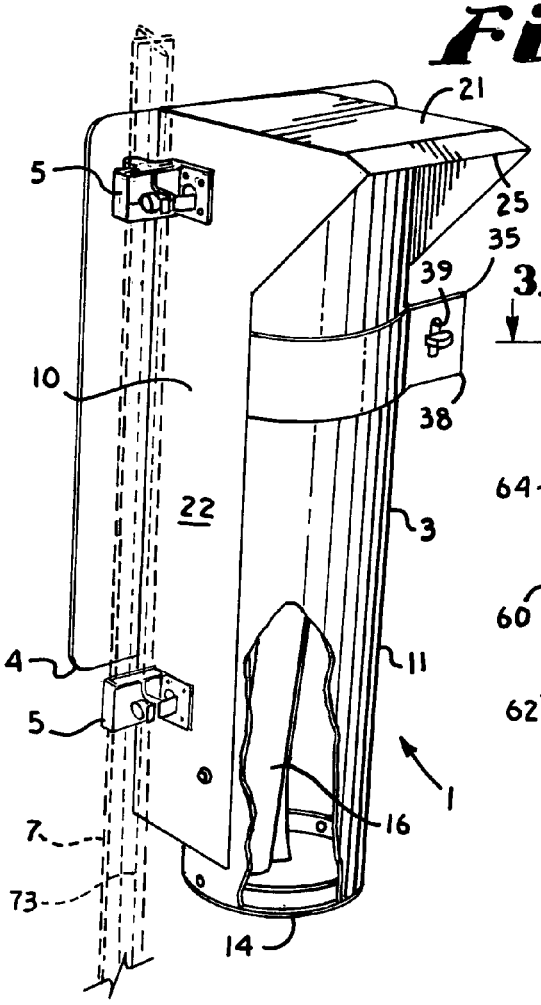
FIG. 1 is a perspective view of a plan box and permit display assembly mounted to a T-post shown in phantom lines and having portions broken away to show a set of rolled construction drawings secured within a plan box of the assembly.
Figure 2:
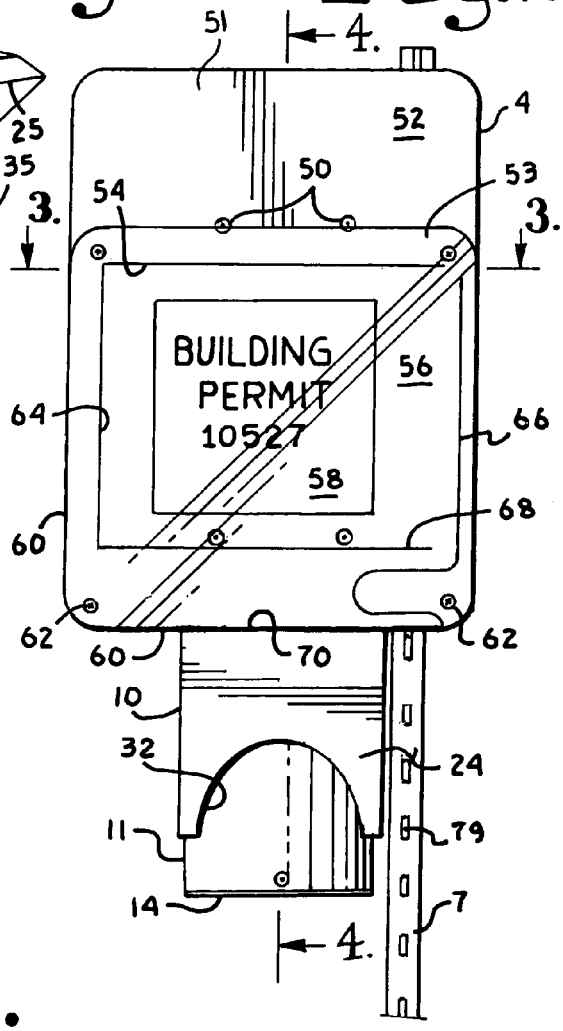
FIG. 2 is a rear plan view of the assembly showing a permit display of the assembly.
Figure 3:
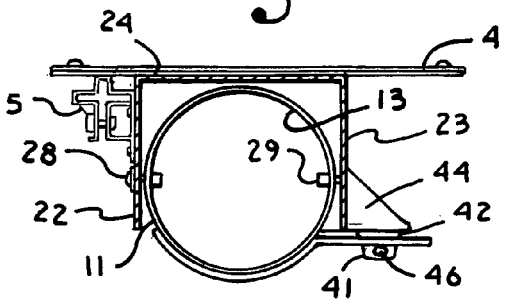
FIG. 3 is a cross-sectional view taken along line 3-3 of FIG. 2.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a plan box and permit display assembly. The assembly 1 includes a plan box 3 with a permit display panel 4 mounted thereto. Clamps 5 mounted on a side of the plan box 3 are adapted for securing the plan box 3 to a standard metal T-post 7.

The plan box 3 includes a housing 10 and a tube 11 pivotally mounted thereto. In the embodiment shown, the tube 11 is shown as cylindrical, however it is to be understood that the tube could be other shapes including a square tube. The cylindrical tube 11 includes an internal, axial bore 13 which is open at an upper end of the tube. It is to be understood that the shape of the bore will typically match the shape of the tube, such that the bore for a square tube will be square in cross-section.

The bore 13 of tube 11 is closed by an end cap or floor 14 secured inside the bore 13 of the tube 11 by rivets or other fastening means. Although the floor 14 is shown at a lower end of the tube 11 it is to be understood that it could be positioned higher up in the bore 13 of the tube 11. The length of the bore 13 from the upper end of the tube down to the floor 14 is preferably slightly greater than the length of a rolled set of standard sized blueprints or plans 16, which is typically twenty-four inches. Longer tubes 11 can be used to accommodate larger sets of plans 16, for example, it is foreseen that a tube slightly longer than thirty six inches could be utilized. The diameter of the tube is selected to provide adequate room to accommodate the diameter of a standard set of rolled construction drawings, and in the embodiment shown is approximately six inches in diameter.

The housing 10 comprises a top wall or roof 21, side walls 22 and 23, rear wall 24 and a downwardly sloping lip or overhang 25 extending across a front edge of the roof 21. The front and the bottom of the housing are open for receiving the cylindrical tube 11 therein. In the embodiment shown, the sidewalls 22 and 23 are approximately as long as the tube 11. The tube 11 is pivotally mounted to the sidewalls 22 and 23 by pivot pins or stub axles 28 and 29 which are connected to the tube 11 near the lower end thereof. In the embodiment shown, the pivot pins 28 and 29 are connected to the cylindrical tube 11 generally along a diameter thereof and approximately three to four inches above the lower end of the tube 11.

It is foreseen that the sidewalls and rear wall of the housing could be formed as a semi-cylindrical structure sized slightly larger than the tube 11, such that the sidewalls and rear wall generally form one continuous curved structure. It is also foreseen that the sidewalls 22 and 23 do not need to be connected directly to the roof 21, rather the sidewalls or side members could be connected only to the rear wall 24 and project forward therefrom to provide structure for pivotally mounting the tube 11. It is also foreseen that the housing could simply comprise a roof 21 and sidewalls 22 and 23 without a rear wall or a front or bottom, particularly if the plan box 3 is to be used without a permit display panel 4.

The roof 21 of the housing 10 shown is rectangular and sized to be larger in length and width than the diameter of the tube 11 so that the roof 21 completely covers the upper, open end of the tube 11 when the tube 11 is oriented vertically. As best seen in FIG. 4, the tube 11 is mounted to the housing 10 such that the upper end of the tube 11 extends in close proximity to the roof 21 when positioned in the housing in a vertical orientation. The lip or overhang 25 slopes downward such that a lower edge of the lip 25 is positioned below the upper end of the tube 11, to help keep rain or snow from being blown into the tube when positioned in the housing in the upright alignment. The roof 21 also extends forward from a front edge of the tube 11 in the upright alignment to space the lip 25 sufficiently forward of the front edge of the tube 11 to further assist in preventing rain or snow from being blown into the tube 11.

As best seen in FIG. 4, a bevel or cutout 30 is formed in a rear upper edge of the cylindrical tube 11 to provide clearance for the tube to pivot beneath the roof 21 of the housing 10. Similarly, a semi-circular cutout 32 is formed in a lower edge of the rear wall 24 of the housing 10 to receive or accommodate a rear lower corner of the cylindrical tube 11 when the tube 11 is pivoted to an open position relative to the housing 10, as shown in phantom lines in FIG. 4, such that the open upper end of the tube 11 is advanced out from under the roof 21. The tube 11 is pivoted to an open position to insert or remove rolled construction drawings 16 from the bore of the tube 11. The tube 11 is then pivoted back to an vertical or closed position to permit weather resistant storage of the drawings 16.

The plan box 3 includes a hasp or hasp assembly 35 to hold or lock the cylindrical tube 11 in the vertical or closed position relative to the housing 10. The hasp 35 includes a strap 37 mounted on a front surface of the tube 11 with a distal section 38 of the strap 37 extending past one side of the tube 11. A slot 39 is formed in the distal section 38 of the strap 37. A swivel member 41 is rotatably mounted on a swivel plate 42 which is connected to a mount 44 formed on housing sidewall 23. The slot 39 is sized to receive the swivel member 41, which is then rotatable to connect the strap 37 to the mount 44 and hold the tube 11 in the closed position. A swivel eye 46 is formed in the swivel member 41 and sized to receive the shackle of a padlock (not shown) to lock the tube 11 closed. The plan box 3 shown provides weather resistant enclosure for securely storing construction drawings or plans 16 at a worksite.

The permit display panel 4 is mounted to the rear wall 24 of the plan box housing 10 by rivets 50 or the like. As used herein, the face of permit display panel 4 opposite the rear wall 24 of the plan box housing 10 may be referred to as the front face or outer face 51 of the permit display panel 4. An upper portion 52 of the outer face 51 is sized to receive stickers or decals for displaying the address of the construction site. A two ply vinyl pocket assembly 53 having a first pocket 54 formed between an inner ply 55 (not shown) and an outer ply 56 of transparent, flexible plastic sheet material is secured to a bottom portion of the front face 51 of the display panel 4 for receiving and displaying flat documents such as a building permit 58.

The pocket assembly 53 shown is generally square. The two plies 55 and 56 are secured together along their respective outer edges 60 by RF heat sealing and the assembly 53 is secured to the front face 51 of the display panel 4 by an adhesive or the like. Rivets 62 are also used to connect the pocket assembly 53 to the back panel 4 near the corners of the pocket assembly 53. A C-shaped weld 64 further connects the two plies 55 and 56 of the pocket assembly 53 and forms three sides of the first pocket 54. A slit 66 is formed in the outer ply 56 generally between the C-shaped weld 64 and a vertical edge 60 of the plies 55 and 56 to provide access to the first pocket 54. The slit 66 is sized to permit the building permit 58 to be inserted therethrough and into the first pocket 54. The outer ply 56 generally sits flush with the inner ply 55 to keep moisture out of the first pocket 56.

The slit 66 continues below a lower leg 68 of the C-shaped weld 64 to provide access to a second pocket 70 formed between the lower leg 68 of weld 64 and lower welded edge 60. The second pocket 70 shown is smaller than the first pocket 54 and is sized to store receipts or the like (not shown). It is to be understood that the plan box 3 could be provided without a permit display panel mounted thereto. However, mounting a permit display panel 4 to the plan box 3 permits both rolled construction documents and flat documents such as building permits to be displayed and stored at the same place at the construction site.

Figure 7:
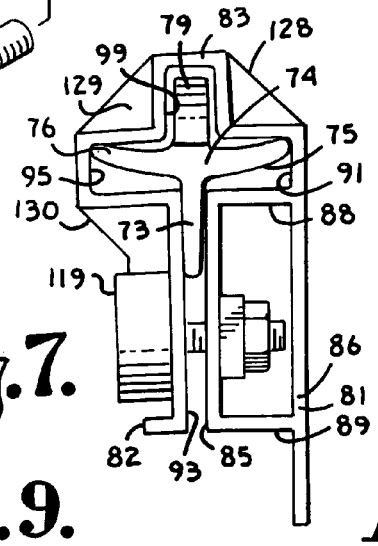
FIG. 7 is a top plan view of the of the T-post clamp connected to a T-post.
Figure 8:
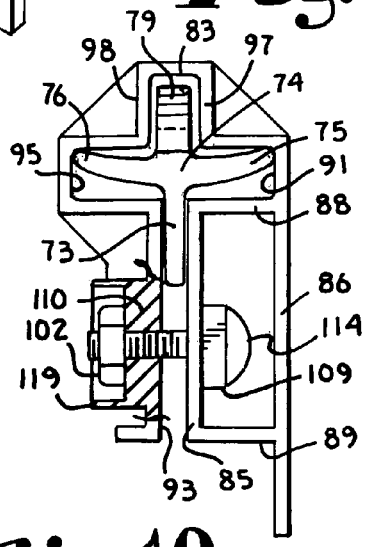
FIG. 8 is a view similar to FIG. 7 with portions broken away, showing a carriage bolt and nut in a different orientation than in FIGS. 6 and 7.

The clamps 5 are mounted on a sidewall 22 of the housing 10 and are adapted to secure or mount the plan box 3 on a post such as a conventional studded steel T-post 7. As best seen in FIGS. 7 and 8, the T-post 7 shown has a generally T-shaped cross-section, with a stem 73 and cross member 74 with first and second cross arms 75 and 76 and studs 79 formed at regular spaced intervals along the length of the cross member 74. Each of the stem 73, cross-member 74, cross arms 75 and 76 and studs 79 may be referred to as a portion of the T-post onto which the clamps 5 may be secured.

Each clamp 5 generally comprises inner and outer clamp halves or clamp members 81 and 82 which are connected together at one end by a flexible web or hinge 83. As used herein, the term hinge is intended to include a flexible web of material as shown in the disclosed embodiment as well as other structure commonly referred to as hinge or providing a hinging function. The inner clamp half 81 may also be referred to as a stationary clamp half and the outer clamp half 83 may be referred to as a movable clamp half. The inner clamp half 81 includes an inner clamp plate or clamping surface 85 spaced outward from a mounting panel 86 in parallel, planar relationship therewith by inner and outer legs 88 and 89. A first cross arm receiver or hook 91 is formed in the inner clamp half 81 between the inner clamping member 85 and hinge 83. The first cross arm receiver 91 defines a slot sized to receive the first cross arm 75 of the T-post cross member 74. The first cross arm receiver 91 hooks onto the first cross arm 75 to prevent the clamp 5 from being pulled sideways or laterally off of the T-post 7.

The outer clamp half 82 includes an outer clamp plate or clamping surface 93 positioned opposite of and in generally parallel planar spaced relationship with the inner clamping plate 85. A second cross arm receiver or hook 95 is formed in the outer clamp half 82 between the outer clamping member 93 and the hinge 83. The second cross arm receiver 95 similarly defines a slot sized to receive the second cross arm 76 of the T-post cross member 74. The second cross arm receiver 91 hooks onto the second cross arm 76 to prevent the clamp 5 from being pulled sideways or laterally off of the T-post 7.

The first cross arm receiver 91 is spaced from the flexible web 83 by a first wall segment 97 and the second cross arm receiver 95 is spaced from the flexible web 83 by an opposed second wall segment 98. The web 83 spaces the first and second opposed wall segments 97 and 98 apart to form a stud receiving channel 99 sized to accommodate or receive any of the studs 79 on the T-post 7.

The inner and outer clamp halves 81 and 82 are sized and shaped to slide onto a T-post from an upper end thereof. A clamp 5 is oriented and mounted on a T-post 7 such that the stem 71 extends between the inner and outer clamping plates 85 and 93, the first and second cross arms 75 and 76 of cross member 74 extend into the first and second cross arm receivers 91 and 95 respectively and the stud receiving channel 99 is positioned to receive any of the studs 79 over which the clamp 5 is positioned. The inner and outer clamping plates 85 and 93 are then drawn toward each other and compressed against the stem 73 of the T-post 7 to fix the relative position of the clamp 5 to the T-post 7 and prevent the plan box 3 from sliding axially along the T-post 7.

The clamp halves 81 and 82 are also preferably sized such that inner surfaces of the first and second cross arm receivers 91 and 92 engage and compress against outer ends of the cross arms 75 and 76 respectively when the clamping members 85 and 93 are drawn against the stem 73 of the T-post 7. The engagement of the cross arms 75 and 76 by the clamp halves 81 and 82 provides further clamping action for securing the clamp 5 to the T-post 7. Because there generally is no standard spacing of the studs 79 on T-posts from different manufacturers, the clamp halves 81 and 82 in the embodiment shown are designed so as not to directly engage or clamp onto the studs 79, although the clamp halves 81 and 82 could be modified to do so.

It is foreseen that the clamp halves 81 and 82 could be formed separately without a hinge connecting the two halves together. As used herein the term clamp halves is not intended to be limited to structure that is approximately equivalent in size. It is to be understood that one of the clamp halves could be significantly larger than the other. For example, it is foreseen that one of the clamp halves may simply comprise a relatively flat clamp panel or member to compress against a portion of the T-post without having a receiver or hook for engaging a cross-arm or other structure on the T-post to prevent lateral sliding relative to the T-post.

In the embodiment shown, the inner and outer clamping members 85 and 93 are drawn together by a carriage bolt 101 and nut 102 extending through aligned, square, bolt holes 105 and 106 formed in the clamping plates 85 and 93 respectively. Annular, square bosses 109 and 110 are formed on respective outer surfaces of the inner and outer clamping plates 85 and 93 around the bolt holes 105 and 106, such that the bolt holes 105 and 106 are at least as long as a square shoulder section 112 of the carriage bolt 101 used therewith. The bolt holes 105 and 106 are sized to snugly receive the square shoulder section 112 of the carriage bolt 101.

Figure 6:
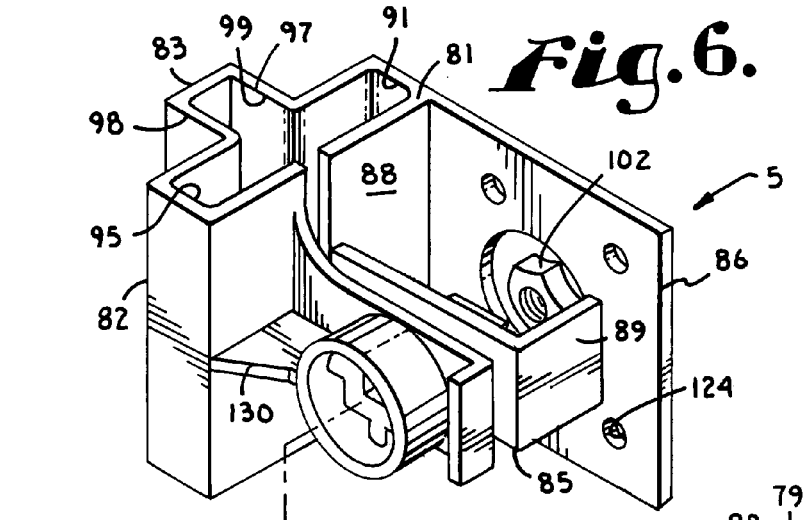
FIG. 6 is an exploded, perspective view of a T-post clamp used to secure the plan box to a T-post.

The carriage bolt may be inserted through the bolt holes 105 and 106 such that its head 114 abuts against the boss 110 on the outer clamping plate 93 and the nut abuts against the boss 109 on the inner clamping plate 85 (as shown in FIGS. 6 and 7) or vice versa (as shown in FIG. 8). A cylindrical wall 119 is formed on the outer surface of the outer clamping plate 93 in spaced relationship around the boss 110. When the carriage bolt 101 is oriented with its head against the boss 109 on the inner clamping plate 85 and the nut 102 against the boss 110 on outer clamping plate 93 (as in FIG. 8) access to the nut 102 can only be had with a socket wrench. The cylindrical wall 119 thereby deters vandals or the like from readily removing the plan box 3 from the T-post 7 unless they happen to be carrying a socket wrench.

Figure 9:
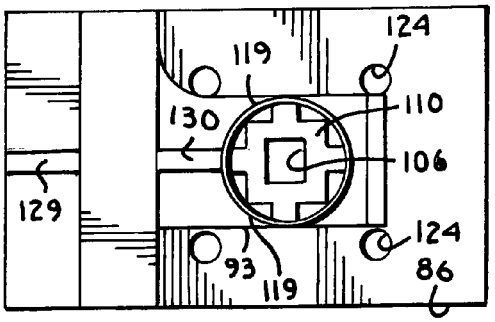
FIG. 9 is a front plan view of the clamp.
Figure 10:
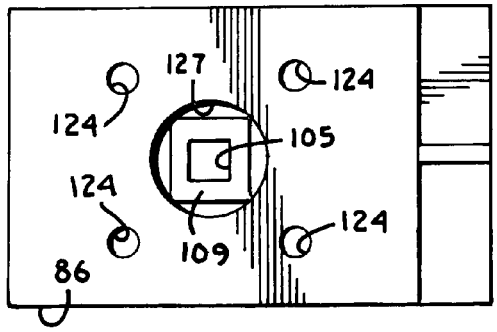
FIG. 10 is a rear plan view of the clamp.

Referring to FIGS. 9 and 10, four mounting holes 124 are formed in the mounting panel 86. Fasteners may be driven through mounting holes 124 to connect the clamp 5 to a sidewall 23 or 24 of the plan box housing 10. The centrally disposed hole 127 through mounting panel 86 is used for molding purposes to facilitate the molding of boss 109 and bolt hole 105 using a slide as is known in the molding arts. In addition, hole 127 allows insertion of the carriage bolt 101 therethrough in the orientation as shown in FIG. 8 with the head 114 positioned against the boss 109 on the inner clamp half 81. Gussets 129, 130 and 131 are formed as part of the clamp 5 to provide desired structural support.

In most applications it is believed that two clamps 5 will be used to mount the plan box 3 and any associated permit display panel 4 to a T-post. T-posts are usually carried by most contractors for use in putting in temporary fencing or other applications on a job site and are generally relatively easy to install versus any wooden post which would be large enough to provide a stable support for the plan box 3. T-posts are also more durable than smaller wooden stakes and space the plan box 3 and permit display panel 4 above the ground at a level which is higher than most wooden stakes which makes it easier to access documents within the assembly 1.

It is to be understood that while certain forms of the present invention have been illustrated and described herein, it is not to be limited to the specific forms or arrangement of parts described and shown. For example, it is to be understood that other forms of permit display apparatus could be used with the plan box 3, including display devices including two leaves or panels hingedly connected together to form a weather tight container for storing documents. It is also to be understood that the clamps 5 could be modified for use in connecting the plan box to posts of different geometries or that the geometry of the clamps could be modified to engage the T-post 7 in a different manner or orientation.

It is also foreseen that means other than the downwardly sloping lip 25 could be utilized to keep moisture from entering the top of the tube 11. For example, an elastic seal such as an o-ring might be attached to the top of the tube 11 to form a seal with an inner surface of the top 21 of the housing.

It is also foreseen that structure other than the floor 14 shown could be used as an obstruction to prevent a rolled set of plans 16 inserted in the tube 11 from falling out the bottom. For example, instead of the two stub axles 28 shown, a single pivot pin extending across the entire diameter of the tube 11 could be utilized to permit pivoting of the tube 11 relative to the housing 10. The pivot pin would also function as an obstruction to prevent a rolled set of drawings from falling out the bottom of the tube and would allow any moisture entering the tube from above to drain out the bottom. It is also foreseen that the floor 14, or the side of the tube just above the floor, could have holes formed therein to permit any fluid that might enter the tube 11 to drain out the bottom.

It is also foreseen that the assembly could be mounted such that the tube is maintained stationary and the roof or housing is pivoted in and out of covering relationship with an open end of the tube. It is further foreseen that the tube could slide relative to the top or cover of the housing, or vice versa, to provide access to the open end of the tube.

What is claimed and desired to be secured by Letters Patent is as follows:

1. A storage device for storing a roll of sheets of paper comprising:

a) a housing having a roof;

b) a tube having an axial bore with an open top and an obstruction extending across at least a portion of said tube to prevent a roll of sheets of paper from falling past said obstruction when positioned in said tube through said open top; said tube pivotally mounted to said housing about an axis extending approximately across a center of said tube and pivotal relative to said roof between a retracted position wherein said roof covers said open top of said tube and an extended position wherein said open top of said tube is pivoted away from said roof such that a roll of sheets of paper may be inserted into said tube;

c) at least one clamp mounted on said housing and adapted to clamp said storage device to a T-post having a stem and outwardly extending cross-arms wherein said clamp comprises;

d) a first clamp member and a second clamp member wherein one of said first and second clamp members includes a mounting member for mounting said clamp to said housing; said first clamp member including a first clamping surface and a first hook extending adjacent said first clamping surface; said second clamp member including a second clamping surface; and e) compression means for urging said second clamping surface toward said first clamping surface to compress said first and second clamping surfaces against a first portion of the T-post with the first hook extending around a second portion of the T-post.

2. The storage device as in claim 1 wherein said compression means comprises a threaded connector connected to said first and second clamp members for drawing said first clamping surface toward said second clamping surface.

3. A storage device for storing a roll of sheets of paper comprising:

a) a housing having a roof and opposed side members;

b) a tube having an axial bore with an open top and an obstruction extending across at least a portion of said tube to prevent a roll of sheets of paper from falling past said obstruction when positioned in said tube through said open top; said tube pivotally mounted relative to said opposed side members of said housing proximate a lower end thereof and about an axis extending approximately across a center of said tube; said tube pivotally advanceable between a retracted position wherein said roof covers said open top of said tube and an extended position wherein said open top of said tube is advanced out from under said roof; and wherein said housing further includes a back panel with a circular recess formed in a lower edge of said back panel to permit a lower rear corner of said tube to pivot rearwardly past said back panel when an upper end of said tube is pivoted forwardly to said extended position.

4. The storage device as in claim 3, in combination with a display panel having a generally planar face and a transparent plastic pocket mounted on said planar face; wherein said transparent plastic pocket is sized to receive a building permit.

5. The storage device as in claim 3 further comprising at least one clamp mounted on said housing and adapted to clamp said storage device to a T-post.

6. The storage device as in claim 5 wherein said clamp includes clamping means for clamping onto a first portion of the T-post to restrain the storage device from axial movement relative to the T-post and hook means for engaging a second portion of the T-post to resist pulling of the storage device off of the T-post.

7. The storage device as in claim 5 wherein said clamp comprises:

a) a first clamp member and a second clamp member wherein one of said first and second clamp members includes a mounting member for mounting said clamp to said housing; said first clamp member including a first clamping surface and a first hook extending adjacent said first clamping surface; said second clamp member including a second clamping surface; and b) compression means for urging said second clamping surface toward said first clamping surface to compress said first and second clamping surfaces against a first portion of the T-post with the first hook extending around a second portion of the T-post.

8. The storage device as in claim 5 wherein said clamp comprises:

a) a first clamp member and a second clamp member connected together by a hinge;

b) said first clamp member including a mounting member for mounting said clamp to said housing; a first clamp plate and a first cross arm receiver extending between said first clamp plate and said hinge;

c) said second clamp member including a second clamp plate and a second cross arm receiver extending between said second clamp plate and said hinge;

d) a connector connected to said first and second clamp members for drawing said second clamp plate toward said first clamp plate to compress said first and second clamp plates against a stem of a T-post when said first and second clamp members are positioned around the T-post with first and second cross arms of the T-post extending in said first and second cross arm receivers respectively.

9. A clamp for connecting an article to a T-post having a stem and a cross-member including first and second cross arms, said clamp comprising:

a) a first clamp member and a second clamp member wherein one of said first and second clamp members includes a mounting member for mounting said clamp to the article; said first clamp member including a first clamping surface and a first hook extending adjacent said first clamping surface; said second clamp member including a second clamping surface; and b) compression means for urging said second clamping surface toward said first clamping surface to compress said first and second clamping surfaces against a first portion of the T-post with the first hook extending around a second portion of the T-post.

10. A clamp for connecting an article to a T-post having a stem and a cross-member including first and second cross arms, said clamp comprising:

a) a first clamp member and a second clamp member connected together by a hinge;

b) said first clamp member including a mounting member for mounting said clamp to the article; a first clamp plate and a first cross arm receiver extending between said first clamp plate and said hinge;

c) said second clamp member including a second clamp plate and a second cross arm receiver extending between said second clamp plate and said hinge;

d) compression means for urging said second clamp plate toward said first clamp plate to compress said first and second clamp plates against a stem of a T-post when said first and second clamp members are positioned around the T-post with first and second cross arms of the T-post extending in said first and second cross arm receivers respectively.

11. The clamp as in claim 10 wherein said compression means comprises a connector connected to said first and second clamp members for drawing said second clamp plate toward said first clamp plate.

12. The clamp as in claim 11 wherein said connector comprises a bolt and a nut and said clamp further comprises aligned bolt holes extending through said first and second clamp plates and a cylindrical wall is formed on an outer surface of said second clamp member in spaced relationship around said bolt hole and said cylindrical wall defining an interior recess sized to receive the nut and a socket wrench for acting on the nut.

* * * * *